US007465159B2

(12) United States Patent
Armantrout et al.

(10) Patent No.: US 7,465,159 B2
(45) **Date of Patent: *Dec. 16, 2008**

(54) FIBER CHARGING APPARATUS

(75) Inventors: Jack Eugene Armantrout, Richmond, VA (US); Benjamin Scott Johnson, Rocky Mount, NC (US); Colby Abraham Rude, Blacksburg, VA (US); Michael Allen Bryner, Midlothian, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 17 days.

This patent is subject to a terminal disclaimer.

(21) Appl. No.: 11/205,458

(22) Filed: Aug. 17, 2005

(65) Prior Publication Data

US 2007/0042069 A1 Feb. 22, 2007

(51) Int. Cl.
*B29C 47/00* (2006.01)

(52) U.S. Cl. ..... 425/7; 425/174.8 R; 425/72.2

(58) Field of Classification Search ..... 425/174.8 R, 425/72.2, 7

See application file for complete search history.

(56) References Cited

U.S. PATENT DOCUMENTS

| | | | | |
|---|---|---|---|---|
| 3,535,588 | A * | 10/1970 | Crook | 361/229 |
| 3,689,608 | A | 9/1972 | Hollberg et al. | |
| 4,215,682 | A | 8/1980 | Kubik et al. | |
| 4,233,014 | A | 11/1980 | Kinney | |
| 4,778,634 | A * | 10/1988 | Douglas | 264/423 |
| 4,904,174 | A | 2/1990 | Moosmayer et al. | |
| 5,296,172 | A * | 3/1994 | Davis et al. | 264/441 |
| 5,397,413 | A * | 3/1995 | Trimble et al. | 156/167 |
| 6,709,623 | B2 * | 3/2004 | Haynes et al. | 264/465 |
| 2002/0084178 | A1 | 7/2002 | Dubson et al. | |
| 2003/0177909 | A1 | 9/2003 | Koslow | |
| 2004/0096533 | A1 * | 5/2004 | Dubson et al. | 425/115 |
| 2005/0087288 | A1 * | 4/2005 | Haynes et al. | 156/167 |
| 2006/0138710 | A1 * | 6/2006 | Bryner et al. | 264/464 |
| 2006/0138711 | A1 | 6/2006 | Bryner et al. | |

FOREIGN PATENT DOCUMENTS

| | | | |
|---|---|---|---|
| FR | 2 815 647 | A1 | 4/2002 |
| WO | WO 91/19034 | A | 12/1991 |
| WO | WO 02/052071 | A2 | 7/2002 |
| WO | WO 03/080905 | A1 | 10/2003 |

OTHER PUBLICATIONS

U.S. Appl. No. 11/023,067, filed Dec. 27, 2004, Bryner et al.

* cited by examiner

*Primary Examiner*—Robert B. Davis
*Assistant Examiner*—Marissa W Chaet

(57) ABSTRACT

A fiber spinning apparatus for charging a polymer-containing liquid stream, having at least one electrically charged, point-electrode positioned adjacent the intended path of said liquid stream and creating an ion flow by corona discharge to impart electrical charge to the polymer-containing liquid stream.

17 Claims, 4 Drawing Sheets

FIBER CHARGING APPARATUS

FIELD OF THE INVENTION

The present invention relates to an apparatus for forming a fibrous web wherein a polymer-containing liquid stream is spun through a spinning nozzle into an electric field of sufficient strength to impart electrical charge on the stream to form fibers, and optionally wherein a forwarding gas stream aids in transporting the liquid stream away from the spinning nozzle.

BACKGROUND OF THE INVENTION

PCT publication no. WO 03/080905A discloses an electroblowing apparatus and method for producing a nanofiber web. The method comprises feeding a polymer solution to a spinning nozzle to which a high voltage is applied while compressed gas is used to envelop the polymer solution in a forwarding gas stream as it exits the spinning nozzle, and collecting the resulting nanofiber web on a grounded suction collector.

There are several disadvantages to the apparatus disclosed in PCT publication no. WO 03/080905A, particularly if the process is carried out on a commercial scale. For one, the spinning nozzle, and the spinneret and spin pack of which the nozzle is a component and all of the associated upstream solution equipment must be maintained at high voltage during the spinning process. Because the polymer solution is conductive, all of the equipment in contact with the polymer solution is brought to high voltage, and if the motor and gear box driving the polymer solution pump are not electrically isolated from the pump, a short circuit will be created which will reduce the voltage potential of the pack to a level insufficient to create the electric fields required to impart charge on the polymer solution.

Another disadvantage of the prior art electroblowing apparatus is that the process solution and/or solvent supply must be physically interrupted in order to isolate it from the high voltage of the process. Otherwise, the solution and/or solvent supply systems would ground out the pack and eliminate the high electric fields required for imparting charge on the polymer solution.

Additionally, all of the equipment in contact with the electrified polymer solution must be electrically insulated for proper and safe operation. This insulation requirement is extremely difficult to fulfill as this includes large equipment such as spin packs, transfer lines, metering pumps, solution storage tanks, pumps, as well as control equipment and instrumentation such as pressure and temperature gauges. A further complication is that it is cumbersome to design instrumentation and process variable communication systems that can operate at high voltages relative to ground. Furthermore, all exposed sharp angles or corners that are held at high voltage must be rounded, otherwise they will create intense electric fields at those points that may discharge. Potential sources of sharp angles/corners include bolts, angle irons, etc.

Moreover, the high voltage introduces a hazard to those persons providing routine maintenance to electrified equipment in support of an on-going manufacturing process. The polymer solutions and solvents being processed are often flammable, creating a further potential danger exacerbated by the presence of the high voltage.

Another disadvantage of the prior art electroblowing apparatus is the necessity of using a quite high voltage. In order to impart electrical charge on the polymer, an electrical field of sufficient strength is needed. Due to the distances involved between the spinning nozzle and the collector, high voltage is used to maintain the electric field. An object of this invention is to lower the voltage used.

Still another disadvantage of the prior art electroblowing apparatus is the coupling of the spinning nozzle to collector distance to the voltage used. During operation of the prior art process, it may be desirable to change the distance of the spinning nozzle to the collector (or the die to collector distance; the "DCD"). However, by changing that distance the electric field generated between the spinning nozzle and the collector changes. This requires changing the voltage in order to maintain the same electric field. Thus, another object of this invention is to decouple the spinning nozzle to collector distance from the electric field strength.

In co-pending U.S. patent application Ser. No.11/023,067, filed Dec. 27, 2004, which is incorporated herein by reference in its entirety, an improvement to the apparatus and process of PCT publication no. WO 03/080905A is disclosed, which discloses an alternative charging method for an electroblowing process and apparatus, which also permits decoupling of the DCD from the electric field strength.

U.S. Pat. No.4,215,682 discloses an apparatus for imparting a persistent electrical charge to melt-blown fibers to form electret fibers, wherein the charging apparatus comprises at least one electrical source in the form of a wire, which is charged to a voltage high enough to form a corona around the source. The melt-blown fibers pass the electrical source and through the corona to form electret fibers with a persistent electrical charge.

SUMMARY OF THE INVENTION

The present invention is directed to an apparatus for spinning fine polymer fibers, comprising a spinneret having at least one polymer supply inlet connected to at least one spinning nozzle outlet from which a polymer-containing liquid stream will issue in an intended path in a downstream direction, a corona charging system positioned downstream of said spinning nozzle and comprising an electrically-charged point-electrode which is electrically insulated from said spinneret, and a target-electrode which is maintained at a different electrical potential from the point-electrode, said electrodes positioned such that an ion field is created between them and is intersected by the intended path of said polymer-containing liquid stream, and a collector positioned downstream of said ion field for collecting said fine polymer fibers.

In another embodiment, the present invention is directed to an apparatus for spinning fine polymer fibers, comprising a spinneret having at least one polymer supply inlet connected to at least one spinning nozzle outlet from which an uncharged, electrically conductive, polymer-containing liquid stream issues in a downstream direction, a corona charging system comprising an electrically-charged point-electrode, downstream of and insulated from said spinneret and positioned such that an ion field is created by said point-electrode and is intersected by said polymer-containing liquid stream, and a target electrode which is said uncharged, electrically conductive, polymer-containing liquid stream, and a collector positioned downstream of said ion field for collecting said fine polymer fibers.

DEFINITIONS

The terms "electroblowing" and "electro-blown spinning" herein refer interchangeably to a process for forming a fibrous web by which a forwarding gas stream is directed generally towards a collector, into which gas stream a polymer stream is injected from a spinning nozzle, thereby forming a fibrous web which is collected on the collector, wherein an electric charge is imparted on the polymer as it issues from the spinning nozzle.

The term "fine polymer fibers" refers to substantially continuous polymeric fibers having average effective diameters of less than about 1 micrometer.

The term "corona discharge" means a self-sustaining, partial breakdown of a gas subjected to a highly divergent electric field such as that arising near the point in a point-plane electrode geometry. In such an arrangement, the electric field, Ep, at the corona point is considerably higher than elsewhere in the gap. To a reasonable approximation Ep is independent of the gap between the electrodes and given by Ep=V/r where V is the potential difference between the point and plane and r is the radius of the point.

The term "average effective diameters" means the statistical average of fiber diameters as determined by measuring the fiber diameter of at least 20 individual fibers from a scanning electron micrograph.

The term "point-electrode" means any conductive element or array of such elements capable of generating a corona at converging or pointed surfaces thereof.

DETAILED DESCRIPTION OF THE INVENTION

Figure 1:
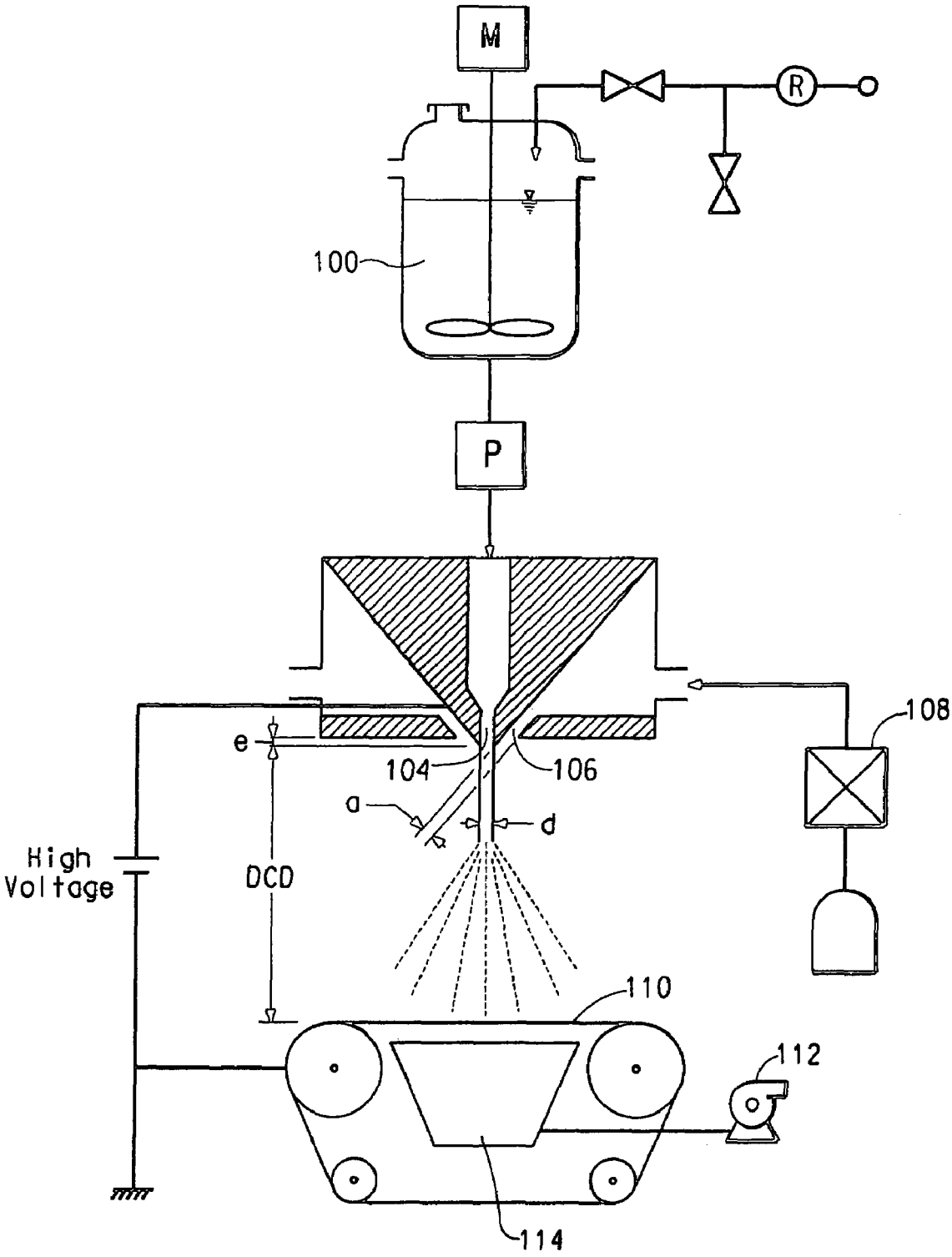
FIG. 1 (Prior Art)
FIG. 1 is an illustration of the prior art electroblowing apparatus.

Reference will now be made in detail to the presently preferred embodiments of the invention, examples of which are illustrated in the accompanying drawings. Throughout the drawings, like reference characters are used to designate like elements.

The present invention is directed to a fiber charging apparatus, wherein an uncharged, electrically conductive, polymer-containing liquid stream is provided to a spinneret and issued, optionally in combination with a forwarding gas, from at least one spinning nozzle in the spinneret. The polymer-containing liquid stream is passed through an ion flow formed by corona discharge so as to impart electrical charge to the polymer-containing liquid stream, so as to form fine polymer fibers. Finally, the fine polymer fibers are collected on a collecting device, preferably in the form of a fibrous web. The charging process of the present invention is illustrated for use in an electroblowing process, but should not be deemed to be limited to such use, as it can be used to form fine polymer fibers in other known fiber spinning processes, such as in melt-blowing.

When the process is practiced in combination with a forwarding gas stream, it is believed that the forwarding gas stream provides the majority of the forwarding forces in the initial stages of drawing of the fibers from the issued polymer-containing liquid stream, and in the case of polymer solution stream simultaneously strips away the mass boundary layer along the individual fiber surface thereby greatly increasing the diffusion rate of solvent from the polymer solution in the form of gas during the formation of the fibrous web.

At some point, the local electric field around the polymer-containing liquid stream is of sufficient strength that the electrical force becomes the dominant drawing force which ultimately draws individual fibers from the polymer stream to form fine polymer fibers with average effective diameters measured in the hundreds of nanometers or less.

A prior art electroblowing process and apparatus for forming a fibrous web is disclosed in PCT publication number WO 03/080905A (FIG. 1), corresponding to U.S. Ser. No.10/477,882, filed Nov. 19, 2003, the contents of which are hereby incorporated by reference. There are several disadvantages to this process, as already described above.

Figure 2:
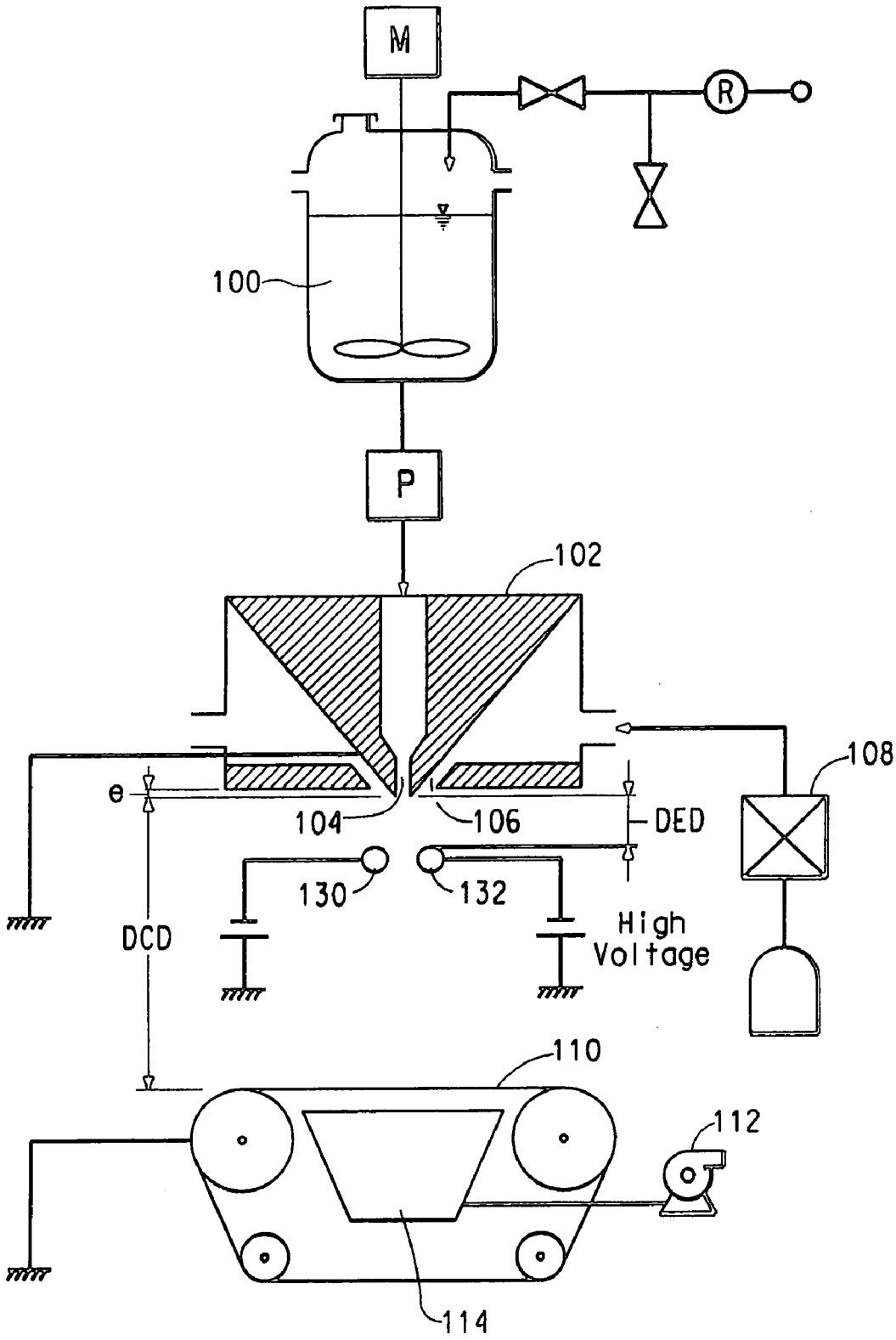
FIG. 2 is an illustration of an electroblowing apparatus disclosed in U.S. Ser. No. 11/023,067.

In another process, the apparatus in FIG. 2 is used to electro-blow fine fibers such that a liquid stream comprising a polymer and a solvent, or a polymer melt, is fed from a storage tank, or in the case of a polymer melt from an extruder 100 to a spinning nozzle 104 (also referred to as a "die") located in a spinneret 102 through which the polymer stream is discharged. The liquid stream passes through an electric field generated between spinneret 102 and electrodes 130 and 132 as it is discharged from the spinneret 102. Compressed gas, which may optionally be heated or cooled in a gas temperature controller 108, is issued from gas nozzles 106 disposed adjacent to or peripherally to the spinning nozzle 104. The gas is directed generally in the direction of the liquid stream flow, in a forwarding gas stream that forwards the newly issued liquid stream and aids in the formation of the fibrous web. Located a distance below the spinneret 102 is a collector for collecting the fibrous web produced. In FIG. 2, the collector comprises a moving belt 110 onto which the fibrous web is collected. The belt 110 is advantageously made from a porous material such as a metal screen so that a vacuum can be drawn from beneath the belt through vacuum chamber 114 from the inlet of blower 112. The collection belt is substantially grounded.

Figure 3:
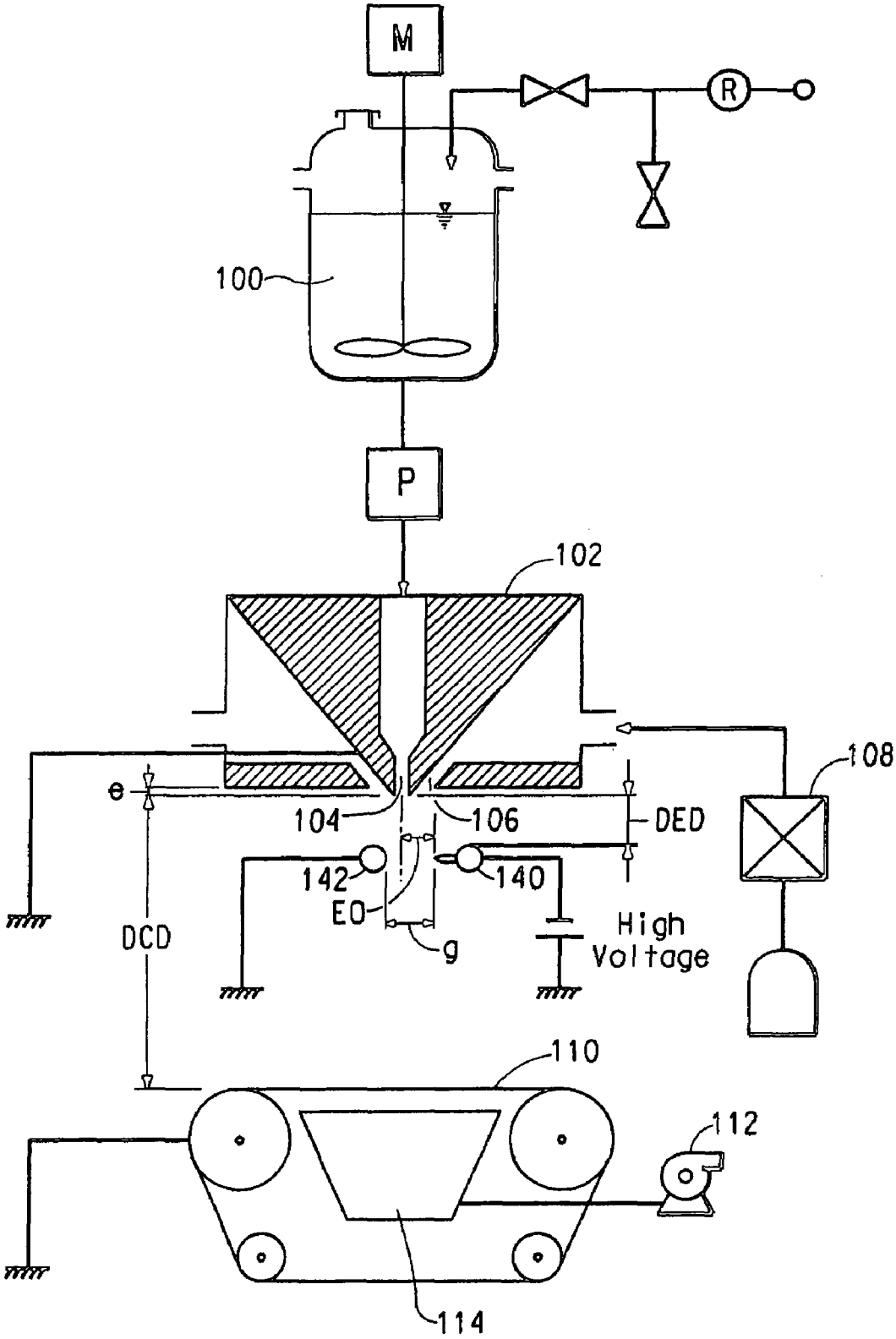
FIG. 3 is a schematic of a process and apparatus according to the present invention.
Figure 5A:
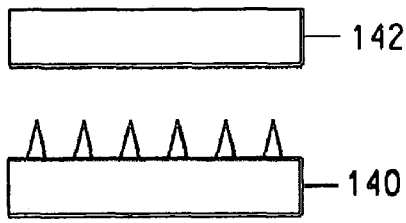
FIGS. 5A-5D illustrate different embodiments of possible electrode configurations for use with the present invention.

According to one embodiment of the present invention (FIG. 3), electrodes 130 and 132 (FIG. 2) are replaced with an electrode arrangement which is capable of creating a corona discharge under relatively low voltage potentials, and yet still imparting sufficient electrical charge to the liquid stream to form the desired fine polymer fibers. In this embodiment, a point-electrode 140 is disposed laterally from the centerline of the intended ("downstream") path of a liquid stream containing a polymer by a variable distance EO (electrode offset), and vertically at a variable die-to-electrode distance DED from spinning nozzle 104, and a target-electrode 142 is likewise disposed laterally to the opposite side of the intended liquid stream path, and vertically below the spinning nozzle. In this embodiment, the point-electrode 140 is illustrated as a bar lined with a series or array of needles that extends the length of spinneret 102 in the z-direction (FIG. 5A), into and out of the page. Likewise, the target-electrode 142 is a metal bar extending the length of spinneret 102. Due to the location of the charging apparatus, the spinning nozzle to collector distance is decoupled from the electric field strength; i.e. the field strength can be controlled independently from the die-to-collector distance.

Figure 5B:
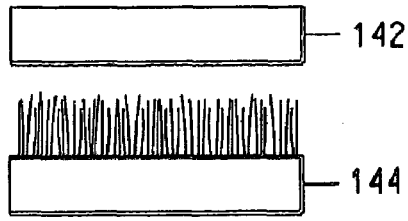
Figure 5C:
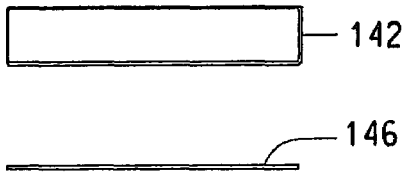
Figure 5D:
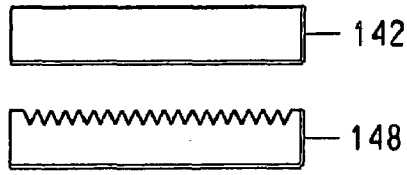

Alternatively, the point-electrode can be made of a plurality of conductive strands, similar to a brush 144 (FIG. 5B), wherein the strands can be made of metal, or of a relatively conductive polymer, such as nylon or an acrylic polymer. In a further embodiment, the point-electrode can be a metal wire 146 (FIG. 5C), which is positioned essentially parallel to the target-electrode, or a serrated knife-edge (FIG. 5D).

In all embodiments of the invention, the DED is short enough to impart electrical charge to the polymer-containing liquid stream prior to fiber formation, e.g. in the case of a molten polymer stream, prior to solidification of fibers formed therefrom.

In another embodiment, an uncharged, electrically conductive, polymer-containing liquid stream passing the point-electrode and through the corona discharge and ionization zones (FIG. 4), can be charged without a separate target-electrode by virtue of the voltage potential difference between the liquid stream, which is maintained essentially at ground potential, and the electrically charged point-electrode.

When present, the shape of the target-electrode is variable. It can be planar, such as in the form of a plate or a bar with a square or rectangular cross-section, or it can be a cylindrical bar. In any event, the functioning of the target-electrode is due to the voltage potential difference between it and the point-electrode. In one embodiment, the grounded spinneret 102 itself can act as the target electrode.

The target-electrode can be made of either a conductive material, such as a metal, or a metal coated with a semi-conductive material, such as a phenolic nitrile elastomer, rubber-type elastomers containing carbon black, and ceramics.

The intended path of the polymer-containing liquid stream that issues from spinning nozzle 104 (FIG. 3) is through gap "g" between the point-electrode and the target-electrode. As illustrated, a high voltage is applied to the point-electrode 140, while the target-electrode 142 is grounded. The distance "g" between the electrodes is sufficient to permit the voltage applied to the point-electrode to initiate an electron cascade so as to ionize the gas in the gap, but not so small as to permit arcing between the electrodes. Distance "g" can be varied based upon the voltage potential applied between the electrodes, as well as based upon the breakdown strength of the gas in the process. Conversely, the voltage potential applied to create the corona discharge can vary depending upon distance "g" and the breakdown strength of the gas used in the process.

Figure 4:
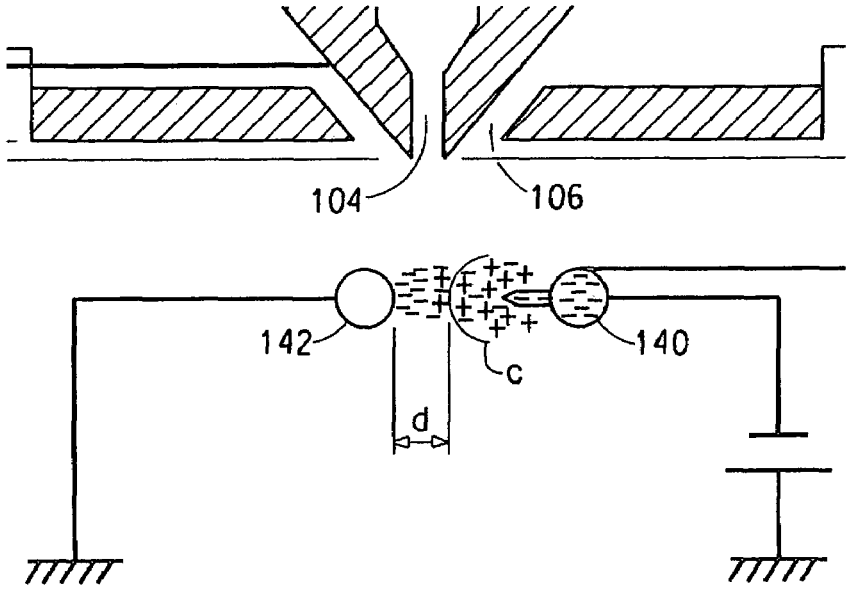
FIG. 4 is a detailed illustration of the corona discharge/ionization zone of the present invention.

FIG. 4 is a detailed illustration of the corona discharge and ionization zones that are formed between electrodes 140 and 142. Upon application of a sufficient voltage potential, a corona discharge zone "c" is formed by electrons emitted from point-electrode 140 ionizing gas near the electrode. In the example of FIG. 4, the point-electrode is negatively charged and the target-electrode is maintained at ground. Both positive and negative ions are formed within the corona ionization zone "c", and the negative ions are drawn toward the target-electrode through an ionization or drift zone, "d", substantially transverse to the direction of the polymer-containing liquid stream flow. When in use, the ions in the drift zone impart electrical charge to the liquid stream passing through it. Those skilled in the art will recognize that the point-electrode could be positively charged, while the target-electrode is maintained at ground.

In one embodiment, the point- and target-electrodes can have the same voltage but with different polarities. In order to form a corona discharge, the voltage differential between the electrodes should be at least about 1 kV, but less than the voltage at which electrical arcing between the electrodes occurs, which again will depend upon the distance between the electrodes and the gas used in the process. Typically, the required voltage differential between the electrodes spaced 3.8 cm apart (in air) is from about 1 kV to about 50 kV.

The process of the invention avoids the necessity of maintaining the spin pack including the spinneret, as well as all other equipment, at high voltage, as in the prior art process illustrated by FIG. 1. By applying the voltage to the point-electrode, the pack, the target-electrode and the spinneret may be grounded or substantially grounded. By "substantially grounded" is meant that the other components preferentially may be held at a low voltage level, i.e., between about −100 V and about +100 V.

The polymer-containing liquid stream of the present process can be polymer solution, i.e. a polymer dissolved in a suitable solvent, or can be molten polymer. It is preferable that at least the polymer is partially electrically conductive and can retain an electrical charge on the time-scale of the process, and when spinning fibers from a polymer solution, the solvent can also be selected from among those that are somewhat conductive and able to retain an electrical charge on the process time-scale. Examples of polymers for use in the invention may include polyimide, nylon, polyaramide, polybenzimidazole, polyetherimide, polyacrylonitrile, PET (polyethylene terephthalate), polypropylene, polyaniline, polyethylene oxide, PEN (polyethylene naphthalate), PBT (polybutylene terephthalate), SBR (styrene butadiene rubber), polystyrene, PVC (polyvinyl chloride), polyvinyl alcohol, PVDF (polyvinylidene fluoride), polyvinyl butylene and copolymer or derivative compounds thereof. The polymer solution can be prepared by selecting a solvent suitable to dissolve the selected polymer. The polymer and/or the polymer solution can be mixed with additives including any resin compatible with an associated polymer, plasticizer, ultraviolet ray stabilizer, crosslink agent, curing agent, reaction initiator, etc.

If desired, electrical dopants can be added to either or both of the polymer or the solvent (when used), to enhance the conductivity of the polymer stream. In this manner, polymers that are essentially dielectric in pure form, such as polyolefins, can be electroblown into fine fibers according to the present process. Suitable electrical dopants include, but are not limited to, mineral salts, such as NaCl, KCl, or $MgCl_2$, $CaCl_2$, and the like, organic salts, such as $N(CH_3)_4Cl$, and the like, conductive polymers such as polyaniline, polythiophene, and the like, or mildly conductive oligomers, such as low molecular weight polyethylene glycols. The amount of such electrical dopant(s) should be sufficient to raise the liquid stream conductivity to at least about $10^{-12}$ Siemens/m (less than about $10^{13}$ ohm-cm resistivity). The fine fibers and the fibrous web formed by the present process have little, or substantially no residual charge, unlike electret fibers that are known-in-the-art. However, it is likely that the apparatus of the present invention, when configured with a separate target-electrode, could be used to form electret fibers from dielectric polymers.

Any polymer solution known to be suitable for use in a conventional electrospinning process may be used in the process of the invention. For example, polymer melts and polymer-solvent combinations suitable for use in the process are disclosed in Z. M. Huang et al., Composites Science and Technology, volume 63 (2003), pages 2226-2230, which is herein incorporated by reference.

Advantageously, the polymer discharge pressure is in the range of about 0.01 kg/cm$^2$ to about 200 kg/cm$^2$, more advantageously in the range of about 0.1 kg/cm$^2$ to about 20 kg/cm$^2$, and the liquid stream throughput per hole is in the range of about 0.1 mL/min to about 15 mL/min.

The linear velocity of the compressed gas issued from gas nozzles 106 is advantageously between about 10 and about 20,000 m/min, and more advantageously between about 100 and about 3,000 m/min.

The fine polymer fibers collected on moving belt 110 have average effective diameters of less than about 1 micrometer, and even less than about 0.5 micrometer.

EXAMPLES

Example 1

A polyvinyl alcohol (PVA), Elvano® 85-82, available from DuPont was dissolved in deionized water to make a 10% by weight PVA solution. The solution electrical conductivity was measured to be 493 micro-Siemens/cm using a VWR digital conductivity meter available from VWR Scientific Products (VWR International, Inc., West Chester, Pa.). The solution was spun in a single orifice electroblowing apparatus comprising a 22 gauge blunt syringe needle, in a concentric forwarding air jet. The needle tip protruded 2 mm below the conductive face of the spin pack body. The spin pack body and the spin orifice were electrically grounded through an ammeter, and the PVA solution was directed through a gap between an array of needles charged to a high voltage, which served as the point-electrode and a grounded, cylindrical target-electrode. Process conditions are set forth in the Table, below.

PVA fine fibers formed via this process were collected on a grounded conductive surface and examined under a scanning electron microscope. The average effective diameter of the fibers collected was about 400 nm.

Example 2

A 7.5% by weight solution of polyethylene oxide (PEO), of viscosity average molecular weight (Mv) 300,000, obtained from Sigma—Aldrich, was dissolved in deionized water. Sodium chloride (NaCl) at a concentration of 0.1 wt % was added to the PEO solution to increase the solution electrical conductivity. Once the solution was thoroughly mixed, the electrical conductivity was measured to be approximately 1600 micro-Siemens/cm, with the same digital conductivity meter being used as in Example 1. This solution was spun through a single orifice electroblowing apparatus with a 20 gauge blunt needle. The process conditions for this run are listed in the Table, below. The charging method for this run is the same as described in Example 1, utilizing a needle array, which served as the point electrode and a grounded, cylindrical target electrode.

PEO fine fibers produced during this run were collected on a grounded conductive surface. The average diameters of these fine fibers were then examined under a scanning electron microscope. The average effective diameter of these fibers was approximately 500 nm.

Example 3

The PEO solution of Example 2 was spun through the single orifice electroblowing apparatus, however the point-electrode geometry was varied. Instead of an array of needles providing the charge, a single wire was used. The solution was directed through the gap between the single wire electrode and a grounded bar, and charged with high voltage. The grounded cylinder served as the target electrode. The conditions used in this run are listed in the Table, below.

The PEO fine fibers were collected on a conductive surface, which was grounded, and their average diameters were examined under a scanning electron microscope, and the average effective fiber diameter from the wire electrode system was also around 500 nm.

TABLE

| | Ex. 1 | Ex. 2 | Ex. 3 |
|---|---|---|---|
| Solution | 10 wt % PVA/water | 7.5 wt % PEO/0.1 wt % NaCl/water | 7.5 wt % PEO/0.1 wt % NaCl/water |
| Solution Conductivity (uS/cm) | 493 | 1600 | 1600 |
| Capillary ID (mm) | 0.41 (22 G) | 0.6 (20 G) | 0.6 (20 G) |
| Charging source | Needle array | Needle Array | Wire and Bar |
| Source polarity | Negative | Negative | Negative |
| Voltage (kV) | 30 | 24 | 25 |
| Solution throughput (mL/min) | 0.25 | 0.25 | 0.25 |
| Air Flow (scfm) | 2.5 | 1.5 | 2 |
| Linear Air Velocity, m/min | 2100 | 1300 | 1700 |
| DED/EO (mm) | 25.5/38 | 25.5/38 | 25.5/38 |
| Die to Collector Distance (mm) | 320 | 305 | 305 |
| Average fiber dia. (nm) | ~400 | ~500 | ~500 |

The data in the Table above demonstrate that the corona charging apparatus of the present invention is an effective substitute for prior art fiber charging systems, which should reduce costs, increase flexibility in processing, and increase safety in such processes.

We claim:

1. An apparatus for spinning fine polymer fibers, comprising:

a spinneret having at least one polymer supply inlet connected to at least one spinning nozzle outlet from which a polymer-containing liquid stream will issue in an intended path in a downstream direction and forwarding gas nozzles disposed adjacent to said spinning nozzle; a corona charging system positioned downstream of said spinning nozzle and comprising an electrically-charged point-electrode which is electrically insulated from said spinneret, and a target-electrode which is maintained at a different electrical potential from the point-electrode, said electrodes positioned such that an ion field is created between them and is intersected by the intended path of said polymer-containing liquid stream; and a collector positioned downstream of said ion field for collecting said fine polymer fibers.

2. The apparatus of claim 1, wherein said point-electrode is positioned such that the ion field is created in a direction transverse to the direction of the intended path of said polymer-containing liquid stream.

3. The apparatus of claim 2, wherein said target-electrode is positioned downstream of said spinning nozzle and on the opposite side of the intended path of said polymer-containing liquid stream from said point-electrode.

4. The apparatus of claim 1, wherein said point-electrode comprises a linear array of conductive needles.

5. The apparatus of claim 1, wherein said point-electrode comprises a plurality of conductive strands.

6. The apparatus of claim 1, wherein said point-electrode comprises a conductive wire positioned parallel to said target electrode.

7. The apparatus of claim 1, wherein said spinneret comprises a beam having a length, with multiple spinning nozzles positioned along said length, and said point-electrode having a length substantially equal to the length of the spinneret and positioned downstream of and substantially parallel to said spinneret and adjacent the intended path of the polymer-containing liquid stream.

8. The apparatus of claim 7, wherein said point-electrode comprises a bar having a linear array of conductive needles disposed substantially perpendicular to and along the length of said bar, wherein said needles are directed toward the intended path of said polymer-containing liquid stream.

9. The apparatus of claim 7, wherein said point-electrode comprises a conductive wire.

10. The apparatus of claim 7, wherein said point-electrode comprises a plurality of conductive strands.

11. The apparatus of claim 1, wherein said target-electrode comprises a semi-conductive material.

12. The apparatus of claim 1, wherein said target-electrode comprises a conductive material.

13. The apparatus of claim 1, wherein said target-electrode is planar.

14. The apparatus of claim 1, wherein said target-electrode is a bar.

15. The apparatus of claim 14, wherein said bar is cylindrical.

16. The apparatus of claim 2, wherein said target-electrode is said spinneret.

17. An apparatus for spinning fine polymer fibers, comprising:

a spinneret having at least one polymer supply inlet connected to at least one spinning nozzle outlet from which an uncharged, electrically conductive, polymer-containing liquid stream issues in a downstream direction, and forwarding gas nozzles disposed adjacent to said spinning nozzle; a corona charging system comprising an electrically-charged point-electrode, downstream of and insulated from said spinneret and positioned such that an ion field is created by said point-electrode and is intersected by said polymer-containing liquid stream which forms a target electrode; and a collector positioned downstream of said ion field for collecting said fine polymer fibers.

* * * * *